United States Patent [19]

Vidal et al.

[11] Patent Number: 4,671,704

[45] Date of Patent: Jun. 9, 1987

[54] COASTAL INSTALLATION FOR LOADING OR UNLOADING LIQUID AT CRYOGENIC TEMPERATURE

[75] Inventors: Jean E. Vidal, Enghien; Andre L. Serio, Meudon, both of France

[73] Assignee: Compagnie Francaise de Petroles, Paris, France

[21] Appl. No.: 765,084

[22] Filed: Aug. 13, 1985

[30] Foreign Application Priority Data

Aug. 30, 1984 [FR] France ..... 84 13415

[51] Int. Cl.[4] ..... F16L 1/04; E21D 10/08

[52] U.S. Cl. ..... 405/195; 405/132; 405/154

[58] Field of Search ..... 405/132, 154, 195, 303; 137/236.5

[56] References Cited

U.S. PATENT DOCUMENTS 3,088,286 5/1963 Wallace ..... 405/195
3,614,869 10/1971 Flory et al. ..... 405/195
3,910,057 10/1975 Fenton ..... 405/195
4,129,010 12/1978 Owen ..... 405/132 X
4,440,524 4/1984 Le Therisien ..... 405/154

*Primary Examiner*—David H. Corbin
*Attorney, Agent, or Firm*—Sughrue, Mion, Zinn, Macpeak & Seas

[57] ABSTRACT

A coastal installation for loading or unloading liquefied natural gas comprises a fixed tower installed on a seabed close to a coast and carrying at the top a rotating mooring arm and a rotating loading arm. Cryogenic pipes connect the coast to the tower, the pipes passing from the coast to below the tower inside a tunnel and then up the tower in at least one vertical casing which penetrates into the tunnel at a point vertically in line with the tower, the upper ends of the pipes being connected to pipes carried by the loading arm by a rotating joint. The cryogenic pipes are thus sheltered against the sea and access to the installation is possible for ships in practically any weather.

5 Claims, 7 Drawing Figures

COASTAL INSTALLATION FOR LOADING OR UNLOADING LIQUID AT CRYOGENIC TEMPERATURE

The invention relates to installations for loading or unloading liquid at cryogenic temperature, paarticularly liquefied natural gas, which are situated close to the shore in order to enable a tanker to moor and to permit loading or unloading of liquid.

It is known that for this purpose it is possible to construct a jetty, along which cryogenic pipes for carrying liquefied natural gas are installed and at the end of which a landing-stage is formed to enable tankers to moor. Installations of this kind are very expensive to construct and do not permit the mooring of ships in all weathers.

The present invention seeks to provide a coastal installation for loading or unloading liquid at cryogenic temperature, the cost of which will be moderate and which permits loading in practically any weather.

According to the invention there is provided a coastal installation for loading or unloading liquid at cryogenic temperatures, comprising a fixed tower installed on the seabed near a coast, carrying at an upper part a rotating mooring arm and a rotating loading arm, and which is provided with fixed cryogenic rising pipes for carrying liquid and connected at their upper ends by a rotatable joint to loading pipes carried by the loading arm, wherein the fixed cryogenic rising pipes are disposed inside at least one vertical casing which penetrates into the seabed, where it leads into a tunnel extending from the coast and ending vertically in line with the fixed tower, and are extensions of fixed cryogenic pipes extending from the coast inside the tunnel, and passing from the interior of the tunnel into the interior of the vertical casing.

The number of vertical casings installed depends on the diameters and the number of the cryogenic pipes. A single vertical casing may be provided through which extend not only the fixed cryogenic rising pipes but also other means of communication or displacement between the tunnel and the fixed tower. Alternatively a plurality of vertical casings may be provided which are disposed in parallel and in each of which passes one of the fixed cryogenic rising pipes, while other vertical casings, disposed in parallel and similar to the aforesaid vertical casings, are provided for the passage of other means of communication or displacement between the tunnel and the fixed tower.

Where a single vertical casing is provided, the lower end of the casing may be provided with a horizontal plate welded externally around the vertical casing, and a concrete roof may be formed above the plate.

Where a plurality of vertical casings are provided, the lower ends of the casings may each be provided with an elemental horizontal plate welded externally around the vertical casing. The elemental horizontal plates may then be welded to one another to form together a single plate, and a concrete roof may be formed above the single plate.

One embodiment of a coastal installation for loading liquefied natural gas, according to the invention, will now be described, by way of example only, with reference to the accompanying drawings.

Figure 1:
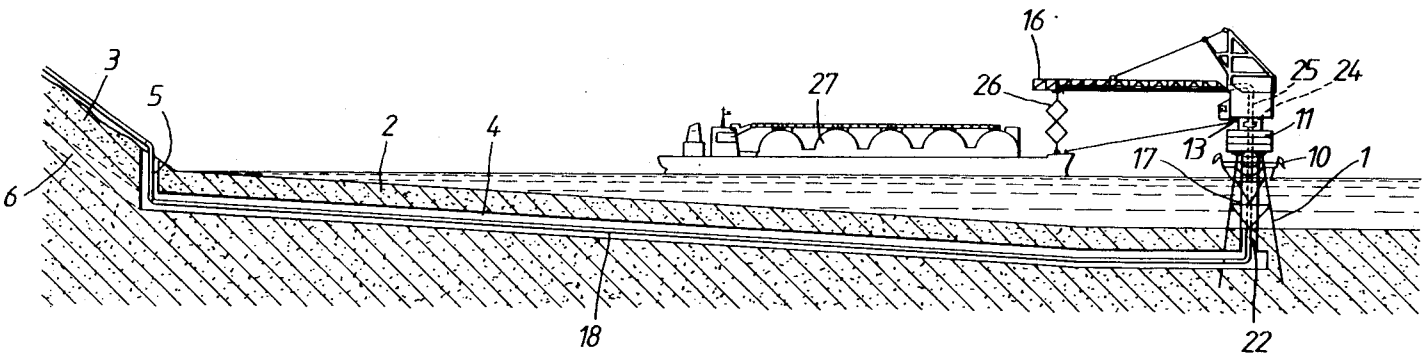
FIG. 1 shows a view partly in elevation and partly in section of an embodiment of a coastal installation acording to the invention and comprising a marine tower having a rotating loading arm and a rotating mooring arm, together with a tunnel connecting the tower to the coast.
Figure 2:
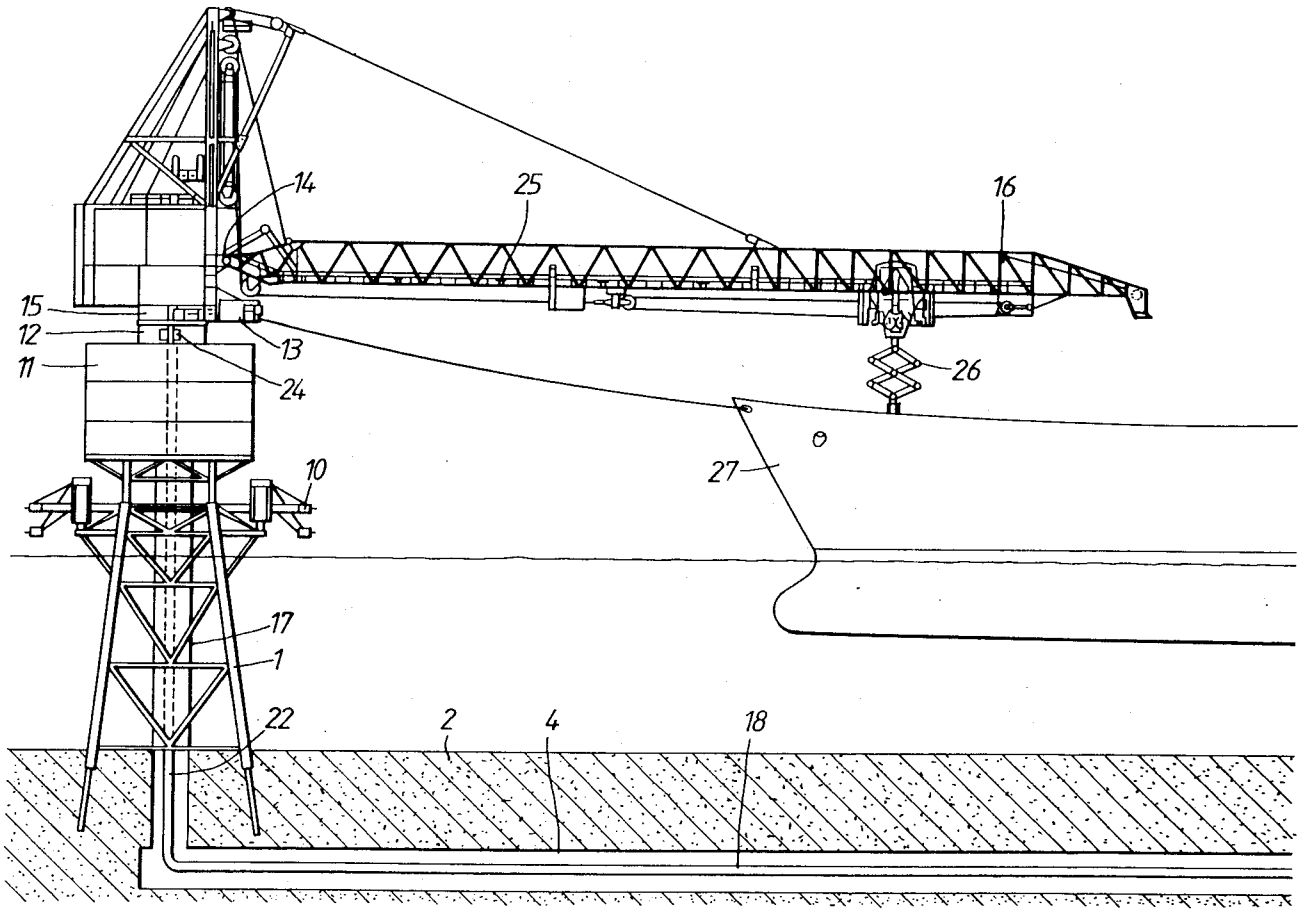
FIG. 2 shows similarly, on a larger scale, the tower and only that portion of the tunnel which is close to it, of the installation of Figure 1.

Referring to FIGS. 1 and 2, the installation comprises a fixed tower 1 which is installed on the seabed 2 near a coast 3 with which communication is made via a tunnel 4.

Figure 5:
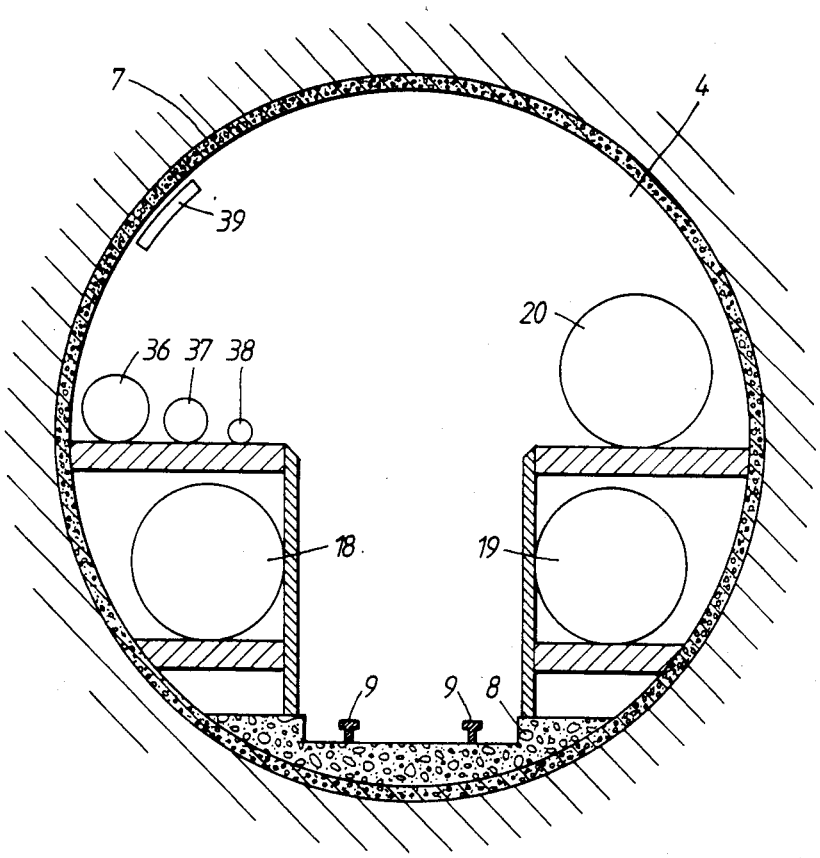
FIG. 5 is a partial vertical cross-section through the tunnel.

In this embodiment the entrance to the tunnel 4 is provided by a vertical shaft 5, but it could also be in an inclined plane as shown in broken lines at 6, which would facilitate the laying of the pipes and would provide a solution to the problems of the expansion of the pipes. The tunnel 4 forms a gallery whose theoretical section may, for example, by of the order of $20m^2$ and which is delimited by a concrete covering 7 of a thickness of about 30cm, which is shown in FIG. 5. At the bottom of the tunnel a concrete floor 8 has been laid to support a railway 9. The railway is used during the construction of the gallery and the laying of the pipes, and also subsequently for maintenance operations. Provision may, for example, be made for circulation on it of a truck equipped with remote control means and hauled by a cable with the aid of a reversible system associated with a winch installed at the surface on the coast 3. The tunnel is also equipped with ventilation means (not shown).

The fixed tower 1 is for example of the so-called "jacket" type with four piers. It is fixed to the seabed 2 by piers of a diameter of 76cm, installed by drilling followed by cementing. The tower 1 is provided with a rotary device 10 for protection against ships, which enables the energy of 300 T.m. to be absorbd. The tower has a multilevel deck 11 which supports the loading equipment. The top level of the deck 11 is provided with a rotating bearing 12 supporting a mooring arm 13 and a loading arm 14. The loading arm 14 comprises a rotating stem 15 and a jib 16, for example of a length of 70 meters. The mooring arm is fixed on the rotating stem 15. A break part (not shown) is provided in the mooring system and has, for example, a breaking point of 150 tonnes.

Figure 4:
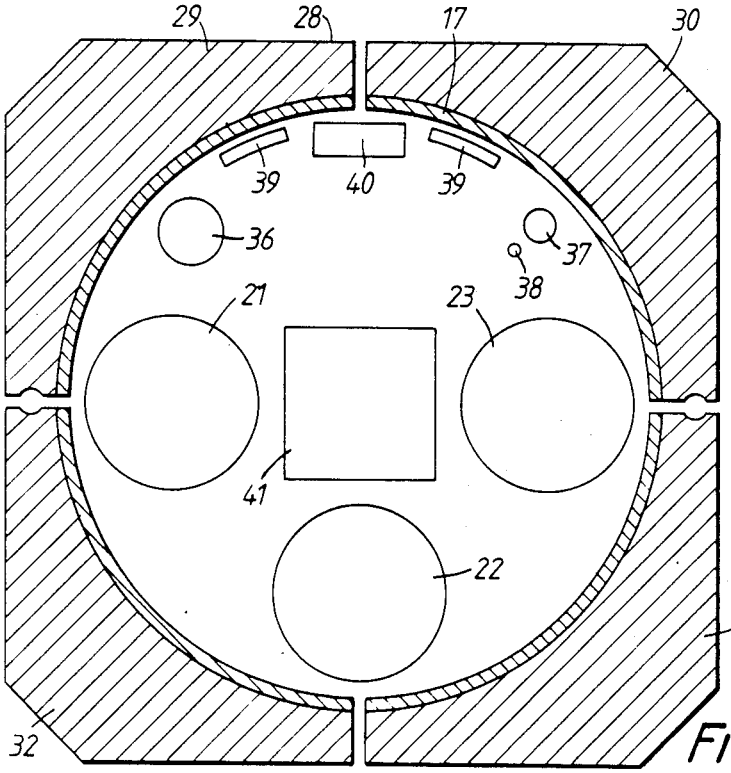
FIG. 4 shows, on a larger scale, a partial horizontal section through this connection region.

A vertical metal casing 17 extends from the tunnel 4 to the top of the fixed tower 1. A continuous passage, protected against the sea, is thus created inside the tunnel 4 and the vertical casing 17, extending from the coast 3 to the top of the fixed tower 1. In this passage are installed, in this embodiment, three cryogenic pipes, of which the substantially horizontal portions 18, 19, 20 extending inside the tunnel 4 from the coast 3 to a point vertically in line with the fixed tower 1 are shown in FIG. 5 and of which the rising vertical portions 21, 22 and 23 extending inside the vertical casing 17 are shown in FIG. 4.

The vertical portions 21, 22, 23 of these cryogenic pipes end in the lower fixed portion of a rotary joint 24, which is shown diagrammatically in FIGS. 1 and 2 because it is per se a conventional joint. Loading pipes 25 start from the upper rotating part of the rotary joint 24 and extend along the loading arm 14 to lazy tongs 26 which permit connection to the front manifold of a tanker 27.

The connection between the casing 17 and the tunnel 4 is made by first driving the casing 17 into the seabed by any of the means well known in civil or mining engineering, and then continuing the tunnel to a point vertically in line with the casing 17. Perfect leak-tightness of the connection can then be obtained in the following manner: around the casing 17, at the point where the latter leads into the tunnel 4, a metal plate 28, such as that shown in FIG. 3, is welded inside the tunnel; it may be more practical for this plate to consist of a plurality of parts, such as the parts 29, 30, 31, 32 shown in FIG. 4, which are welded in place to the casing 17 and to one another; above the plate 28 a concrete roof 35 is constructed with the aid of a mortar introduction pipe 33 and an air evacuation pipe 34, these pipes being shown in FIG. 3.

In the passage formed by the tunnel 4 and the casing 17 are also disposed auxiliary pipes 36, 37, 38 (FIGS. 4, 5 and 6) for vapour return, supply of nitrogen, and supply of water, as well as electric cables 39.

Figure 3:
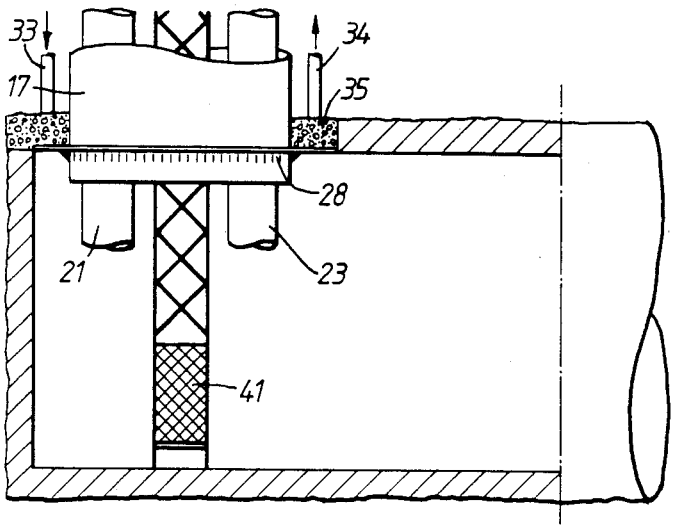
FIG. 3 is a part elevation and part vertical section, on a larger scale, through the region of the connection between the tunnel and a vertical casing vertically in line with the tower.

The casing 17 also permits the installation of a ladder 40 and a nacelle 41, both of which are shown in FIG. 4, the nacelle being also shown in FIG. 3, in which the pipe 22 is not shown.

Figure 6:
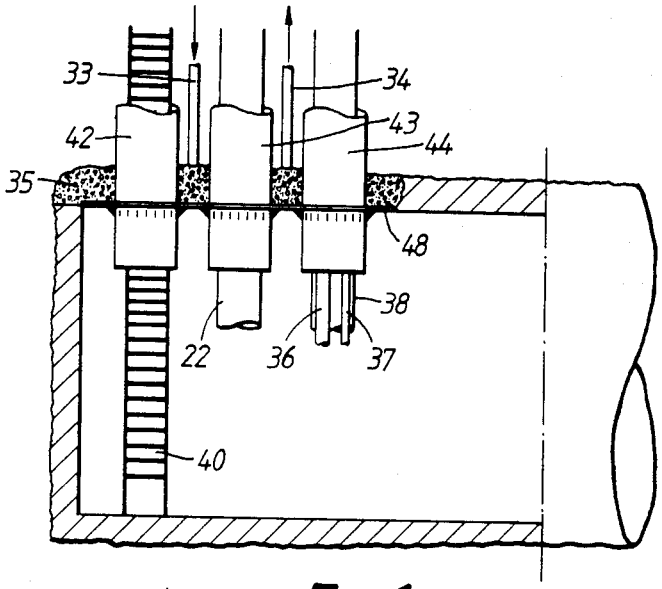
FIG. 6 is a part elevation and part vertical section through the region of the connection between the tunnel and a plurality of vertical casings, vertically in line with the tower.
Figure 7:
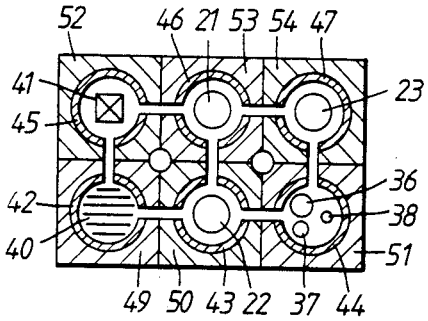
FIG. 7 is a partial horizontal section through the connection region shown in FIG. 6.

FIGS. 6 and 7 illustrate a modification in which the single casing 17 has been replaced by a plurality of casings 42, 43, 44, 45, 46, 47 containing respectively: the ladder 40, the cryogenic pipe 22, the auxiliary pipes 36 to 38, the nacelle 41, the cryogenic pipe 21, and the cryogenic pipe 23.

As in the preceding embodiment, a concrete roof 35 has been constructed above a metal plate 48 formed in this embodiment of elemental plates 49, 50, 51, 52, 53, 54, each of which may in turn be composed of a plurality of parts, the whole arrangement being welded to each of the casings 42 to 47 and the various component parts being welded together.

The operation of the loading installation described above is particularly simple and reliable.

A tanker takes up position in a manner similar to well known methods for petroleum product loading towers, for example with the aid of a cable suspended from the jib 16 of the loading arm 14, without requiring a support ship or tug. Once the cable has been made fast, the lazy tongs make the connection to the front manifold of the tanker. These operations have the advantage of being possible even in heavy weather, and of being quick. Moreover, the tanker can leave the loading installation quickly and in a simple manner.

Holding station presents no problem in respect of short period movements to which the tanker is subjected in heavy weather, because the loading arm is designed for operating under severe conditions. Since bifluid and cryogenic rotary joints at present available on the market may be inadequate for the passage of the full loading flow and vapour return in a single joint, it may become necessary to use a plurality of joints disposed in parallel. The rotation of the loading arm 14 may then be limited to a sector of about 300°. If the loading arm 14 strikes against its stop, it is necessary for the connection to the tanker to be quickly broken and to wait for the tanker to return to a favourable position. As the dead sector of 60° is oriented in accordance with the dominant directions of the wind, current and swell, this disconnection operation is exceptional. Furthermore, tankers are generally equipped with bow propellers and main propulsion by variable pitch screws, so that they are able to manoeuvre in order to remain within the operative sector of the loading arm.

Forces due to the slow drift movements of the tanker are estimated at less than 100 tonnes under extreme conditions. Force measurement means may be provided at the mooring hook in order to be able to make a quick disconnection as soon as the forces exceed 100 tonnes. In any case, the structure of the tower is protected by a break part in the mooring system, breaking at 150 tonnes. The elasticity of the mooring system is adjusted in dependence on the deflection movements tolerated by the loading arm.

What is claimed is:

1. A coastal installation for loading or unloading liquid at cryogenic temperature, comprising a fixed tower installed on the seabed near a coast, a rotating mooring arm and a rotating loading arm carried by an upper part of said tower, fixed cryogenic rising pipes for carrying liquid associated with said tower, loading pipes carried by said loading arm, a rotatable joint connecting the upper ends of said rising pipes to said loading pipes, at least one vertical casing for said rising pipes, which casing penetrates into the seabed, a tunnel extending from the coast and ending vertically in line with said fixed tower where it is penetrated by said vertical casing, fixed cryogenic pipes forming extensions of said rising pipes and extending from the coast inside said tunnel and passing from the interior of said tunnel to the interior of said vertical casing.

2. A coastal installation according to claim 1, comprising a single said vertical casing in which said fixed cryogenic rising pipes extend, and other communication or displacement means extending in said vertical casing between said tunnel and said fixed tower.

3. A coastal installation according to claim 1, comprising a plurality of vertical casings in parallel, in each of which one of said fixed cryogenic rising pipes extends, other vertical casings in parallel, similar to the vertical casings being provided for the passage of other communication or displacement means between said tunnel and said fixed tower.

4. A coastal installation according to claim 2, wherein at its lower end said vertical casing is provided with a horizontal plate welded externally around said vertical casing, and a concrete roof is formed above said plate.

5. A coastal installation according to claim 3, wherein at their lower ends the casings are individually provided with elemental horizontal plates welded externally around the vertical casings, said elemental horizontal plates are welded to one another to together form a single plate, and a concrete roof is formed above said single plate.

* * * * *